United States Patent [19]

Rosenstock

[11] 4,222,684

[45] Sep. 16, 1980

[54] METHOD OF DRIVING SHEET PILES INTO A ROCK SUBSTRATUM

[76] Inventor: Winfried Rosenstock, Heyestr. 28, 3068 Obernkirchen, Fed. Rep. of Germany

[21] Appl. No.: 954,435

[22] Filed: Oct. 25, 1978

[30] Foreign Application Priority Data

Oct. 26, 1977 [DE] Fed. Rep. of Germany ..... 2747937

[51] Int. Cl.[2] ..... E02D 7/12

[52] U.S. Cl. ..... 405/232; 405/274; 405/284

[58] Field of Search ..... 405/229, 232, 234, 237, 405/238, 244, 245, 248, 253, 254, 272, 274, 276, 278, 284, 285

[56] References Cited

U.S. PATENT DOCUMENTS

| | | | |
|---|---|---|---|
| 1,140,303 | 5/1915 | Feder | 405/245 X |
| 1,164,085 | 12/1915 | Goldsborough | 405/244 |
| 1,931,249 | 10/1933 | Burkhardt | 405/253 |
| 3,563,044 | 2/1971 | Gerwick | 405/284 X |

FOREIGN PATENT DOCUMENTS

| | | | |
|---|---|---|---|
| 83674 | 4/1921 | Austria | 405/234 |
| 37590 | 7/1923 | Norway | 405/244 |

*Primary Examiner*—Dennis L. Taylor

*Attorney, Agent, or Firm*—Warren, Chickering & Grunewald

[57] ABSTRACT

Problems arise when erecting a sheet pile on rock substratum and subsequently anchoring the piles. If a channel is blasted, this has the draw-back that the over burden has to be initially cleared prior to blasting and then replaced subsequently. In addition, the piles when secured in the blasted channel when refilled with concrete and the anchors in the rock substratum are not as securely supported as piles driven into normal substratum. A method of erecting sheet pile and a method of anchoring the sheet pile is disclosed where the substratum is shattered by blasting sufficiently to allow the piles and the anchors, which are also piles, to be driven into the rock substratum. Each method involves drilling bore holes and inserting a water tight charged container into these and determining the volume of charge relative to container volume such that the rock substratum surrounding a bore hole after detonation is not significantly damaged in its external form but has a shattered internal structure allowing pile driving.

10 Claims, 7 Drawing Figures

METHOD OF DRIVING SHEET PILES INTO A ROCK SUBSTRATUM

BACKGROUND TO THE INVENTION

This invention relates to a method of driving sheet piles into a rock substratum, both for the purpose of producing a sheet pile wall and also for subsequently anchoring the sheet pile wall. The invention is particularly intended for use in marine and river works, but is also suitable for every other civil engineering branch in which a sheet pile wall must be placed in a rock substratum.

In the engineering of inland and coastal ports or other waterways, provision must frequently be made for great differences in water level and, because of the trend towards ever larger ships, for very large draft. For the berths, sheet pile walls are generally used, which are composed of individual sheet piles adjoining one another and must be driven to a predetermined depth to provide a secure fixing. Frequently, however, this required driving depth cannot be achieved, because a rock substratum is present at quite shallow depth in the soil structure, preventing any driving beyond this depth.

Such a driving depth limited by a rock substratum is not harmful if the lower ends of the sheet piles can be fixed in the rock substratum sufficiently for the piles to obtain adequate fixity even though the theoretically calculated driving depth based upon soft soil conditions is not reached. Because the piles have sharp bottom edges, the bottom end of the piles can usually be driven without great difficulty to a sufficient penetration for reliable fixity, provided the rock substratum is comparatively soft. With a harder rock substratum, however, this simple driving is no longer possible, because the bottom ends of the piles become upset when driving is attempted, or they buckle sideways.

For these difficult ground conditions a process is known, in which the sheet piles are no longer driven, but are set into a channel blasted in the rock and concreted in there using underwater concrete. This process is extraordinarily complicated and costly, since before the generally V-shaped channel can be blasted, all loose rubble and the like overlying the rock must be removed, it being necessary in fairly loose overburden to maintain an angle of slope of 3:1, in order reliably to prevent the channel from filling up after blasting. After placing of the sheet piles in the V-trench and the subsequent concreting operation, it is frequently necessary to backfill the loose material that has been removed with so much trouble, in order to assure the final stability of the finished sheet pile wall. Apart from the extra work required, the real advantages of a sheet pile wall, namely its firm fixing in the soil resulting from the compaction of the substratum during driving, are completely lost, and instead the sheet pile wall is installed after the manner of a freestanding wall.

When a non-drivable rock substratum is present, difficulties are encountered not only in the construction of the sheet pile wall, but also corresponding difficulties exist in its subsequent lateral anchoring. After the erection of a sheet pile wall, that is after the driving of the individual sheet piles, it can be necessary for the upper end of the sheet pile wall to be secured against displacement, which is usually effected by means of anchors, which extend approximately at 45° obliquely downwards from the upper edge of the sheet pile wall. Such an anchorage is provided especially for those sheet pile walls that are subjected to high soil pressure on one side, and which are supported in the driven state at the lower end only, as a consequence of the existing soil structure. Very frequently, these conditions occur in the securing of banks and in the construction of quay structures for waterways where a rock substratum is present at the place where land meets water.

The usual method of installing the anchors on the landward side of the sheet pile wall for a non-drivable rock substratum consists in drilling boreholes obliquely downwards from the seaward side from the upper edge of the wall, and then positioning simple anchors in the form of steel flats or angles loosely in the boreholes. The boreholes together with the anchors in them are then completely filled with concrete, which after hardening produces retaining forces predominantly due to frictional bond between the concrete and the wall of the borehole. Due to a lack of compaction of the ground material, such as is produced in driving, these retaining forces are not especially high per unit area, so that the frictional area between the concrete and the borehole wall must be designed to be correspondingly large. For this reason the anchors must frequently be made very long, resulting in a steep increase in the drilling costs.

A further disadvantage of this anchoring method lies in the fact that, if the bond friction is temporarily lost for example due to a blow or a shock, only sliding friction remains effective, which, as is well-known, provides much lower retaining forces than bonding friction. Such impacts can arise, for example, from careless berthing of a ship alongside the sheet pile wall or from other vibrations, for example from a road in the vicinity. Vibrations arising from blasting which must be carried out in the vicinity of the sheet pile wall are especially dangerous. This is always the case when the useful draft of the waterway adjacent to the wall must be increased and, on account of a rock substratum, blasting is unavoidable. There is then a risk that the sheet pile wall will lose the holding power of its anchors over a very large length immediately after blasting, and will be forced away by the soil pressure.

Considered overall, it has therefore hitherto not been possible, where a non-drivable rock substratum is present, to construct sheet pile walls by simple driving of the lower ends of the piles and to anchor them laterally where necessary by simple driving of anchors. Instead, it has hitherto been necessary to adopt other measures, in which no driving operations were involved and in which, apart from other disadvantges, it was also necessary to accept that the very high retaining forces which arise from driving piles due to the resultant compaction of the substratum could not be achieved.

SUMMARY OF THE INVENTION

It is an object of the invention to create a method which enables stable sheet pile walls to be constructed by driving the lower ends of sheet piles even where a hard, intrinsically non-drivable rock substratum is present, and to fix the lateral anchors for such sheet pile walls by driving.

For the erecting of sheet pile walls, the invention provides that holes are bored through any overlay present into the rock substratum at predetermined spacings along the intended wall, that a watertight container containing an explosive charge is inserted into each hole, the volume of the explosive charge being small by comparison with the volume of the container, that the explosive charges of at least two adjacent holes are simultaneously detonated, and that then the sheet piles are driven into the rock substratum of shattered internal structure but still almost undamaged external form between the holes.

The principle of this invention therefore consists in making possible the driving of the individual sheet piles forming part of a sheet pile wall into an intrinsically non-drivable rock substratum, as a result of the fact that the rock substratum is made drivable by means of an explosion. This explosion is not a blasting-away in the usual sense, but a type of shattering blasting, which is carried out by means of an explosive charge prepared according to this invention and which to a certain extend "softens" the rock substratum. The individual sheet piles can then be driven successively into a rock substratum prepared in this manner, without especial difficulty and especially without the risk of an upsetting or buckling of the lower ends of the piles, the rock material displaced in the driving of the piles causing a compaction of the stratum "softened" by the explosion, which results in a firm and secure fixing of the sheet pile wall in the substratum.

By contrast to the usual introduction of a charge for blasting away rock for example, in the invention the explosive charge is housed inside an expansion chamber formed by the container, which serves as a first expansion space after the detonation. It has been found that pressure waves spread out from the peripheral zones of this expansion chamber, these waves being well capable of shattering the internal structure even of a very hard rock, but not causing any noticeable change in position. This effect takes place in all directions around the source of pressure waves, and is purposefully amplified in a preferred direction by the fact that a second similar pressure wave source, that is an explosive charge prepared according to this invention, is installed at a predetermined distance. If the distance is correctly selected—it is about ten times the borehole diameter, usually 60 to 150 cm—the entire rock structure situated between the two boreholes is then shattered to a width of at least three times the borehole diameter to such an extent that a sheet pile wall can be driven in with about 25 to 40 blows per 10 cm.

The container serving for forming the expansion chamber in the environment of the explosive charge should preferably be of plastics material, but in any case must not be of metal. If parts of the container remain behind after detonating of the charge in the region into which the sheet pile walls are later to be driven, then any plastics residue will never interfere with spatial movement, whereas metal pieces could constitute a considerable hindrance. The simplest procedure is to make the containers from cutting lengths from continuous PVC tubes, and then closing the ends of the length with appropriate caps. Tubes of this type are commercially available as drainage pipes at a favourable price.

In general, no special measures are necessary for centering the charge inside the container, since it is not of importance for the described effect of pre-expansion whether the explosive charge, usually in the form of cords, rests against the wall of the container or is in the middle. If for any reason, however, centering is desired, suitable spacers may be used. The only important thing is that a sufficiently large gas space shall be available inside the container to serve as the expansion volume. The smaller this expansion volume is, the more the charge will have a tendency to displacement, that is to change the position of the rock, and if the expansion volume is completely absent, this displacement effect is the only one that occurs.

In regard to the further aspect of fixing lateral anchorages for a sheet pile wall, the invention starts from the known measure of providing a boring extending obliquely downwards from the upper edge of the wall into the rock substratum. According to the invention, provision is also made for a sheet pile to be used as anchor, for the diameter of the borehole to be made smaller than the maximum width of the sheet pile, for a watertight container containing an explosive charge to be inserted into each borehole, for the volume of the explosive charge to be so chosen in relation to the volume of the container that, after the charge has been detonated, the rock structure in the vicinity of each borehole is drivable for the associated sheet pile due to a shattering and the borehole is widened out slightly to a hole, and that the sheet pile is driven approximately with its central axis along the axis of the hole.

In an important further embodiment of the basic concept of the invention, therefore, use is again made of the principle of "softening" the previously non-drivable rock substratum by means of a shattering blast, for the fixing of the lateral anchors of sheet pile walls. Here again, the explosive charge is housed inside a container constituting an expansion space, from the peripheral zones of which the pressure waves which shatter the rock structure spread out, without producing any notable change in position. A slight change in position, which consists in the slight expanding of the original borehole to a hole, can be easily regulated by an appropriate design of the size of the expansion chamber. The blasting is therefore so carried out that both a destruction of the rock structure of the surrounding rock occurs and also the preliminary stages of a blasting for displacement comes into effect, but the latter in so mild a form that the result is a widening out of the borehole to a hole, but not yet a displacement of the wall forming the hole. In this connection, the volumetric ratio between the explosive charge and the container cannot be determined firmly in advance, but will depend in each case upon the type of rock in which the anchor is to be formed. It is obvious that for a fairly soft rock substratum, the preliminary stages of the blasting for displacement must be smaller in their effect than for an especially hard rock.

The destruction of rock structure produced by the blasting and thus the loosening is basically necessary in order that driving can be carried out at all into the rock. It is also, however, necessary that for the lateral anchoring of the sheet pile wall a steel flat or anglesection which fits into the borehole shall no longer be used, but instead a usual sheet pile, which exceeds in its dimensions the dimensions of the borehole, which is to be expanded to form a hole. In the subsequent introduction of the sheet pile, the borehole then serves as a displacement chamber for the material displaced by the sheet pile. This displacement volume formed by the borehole is smaller than the displacement volume necessary for the volume of the sheet pile, which in turn has the result that a compacting of the surrounding rock substratum loosened by the blasting results from the introduction of the sheet pile. This leads to very high retaining forces for the driven anchor and thus to a firm and reliable flxity of the anchor.

Before blasting, the holes have a diameter of about 32–65 mm. After detonation of the charges, the dimensions of which will depend upon the experience gained from preliminary trial blasting, a region of approximately 500 mm diameter around the hole and along its axis is usually altered by the blasting, that is in particular is destroyed in its structure. From the external diameter of the hole to the edge of the altered region, the compacting of the rock when piles are driven decreases progressively. The sheet piles are driven in such a way that their central region is approximately in the centre of the hole, and thus the two longitudinal edges are driven in the rock substratum loosened by the blasting. For fairly large sheet piles or for appropriate soil conditions, it is also possible for two holes situated alongside each other to be drilled for one and the same sheet pile, in which case when driving the centres of the holes are situated approximately in the region of the outer edges of the sheet piles.

When anchoring a sheet pile wall according to the method of this invention, either fewer anchors or shorter anchors may be used for attaining the same stability of the sheet pile wall. The preparatory work is correspondingly cheaper, so that the method according to this invention makes possible not only a reliable but also a cheaper anchorage than hitherto.

Where the demands upon the anchor in respect of its holding forces are unusually high, a somewhat longer anchor and thus a greater length of borehole is necessary for correspondingly unfavourable soil conditions. It may then be of advantage, instead of a single container, to arrange several one after the other, so that approximately the same alteration to the rock occurs at every depth along the axis of the borehole. Alternatively, a single, long container may be used, in which a plurality of explosive charges, adapted in respect of volume to the conditions, are disposed one after the other. Independently of the arrangement, all explosive charges associated with one borehole are always simultaneously detonated.

Regardless of whether a sheet pile wall is being constructed or lateral anchors are being fixed for a sheet pile wall, the method according to the present invention is suitable both for rock in the dry and also for rock underwater, and any drivable overburden which may be present above the rock substratum is not a further disadvantage. The introduction of the containers into the boreholes is most easily done by means of tubes, which are introduced to follow up the drilling tool during the drilling of the borehole, and thus prevent the new borehole from becoming filled up. After the containers have been inserted through these tubes, the tubes can immediately be removed. Even if the borehole then becomes filled up, this is in no way harmful to the effects of the blast.

BRIEF DESCRIPTION OF EMBODIMENTS

The further objects and advantages of the invention will be explained in more detail below with reference to the two nonlimiting embodiments illustrated in the drawing. The drawings show:

FIG. 1 a diagrammatic plan on a row of bore holes for the construction of a sheet pile wall, FIG. 2 a diagrammatic side view in section of the row of boreholes of FIG. 1, FIG. 3 a diagrammatic cross-sectional view through a sheet pile wall with an associated anchor, and FIG. 4 A and B in two somewhat different forms of embodiment, a diagrammatic plan on the anchor in the direction of driving.

DETAILED DESCRIPTION OF EMBODIMENTS

Figure 1:
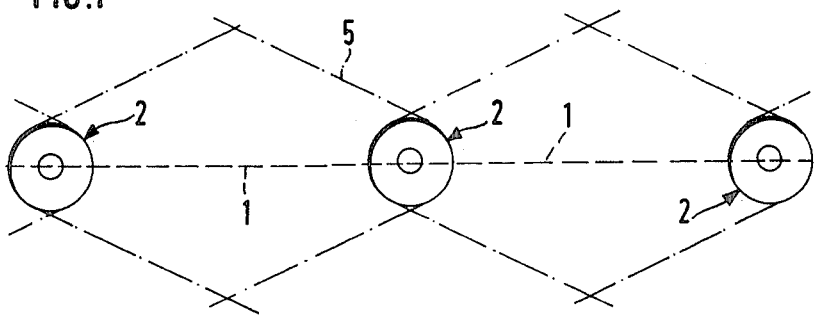
Figure 2:
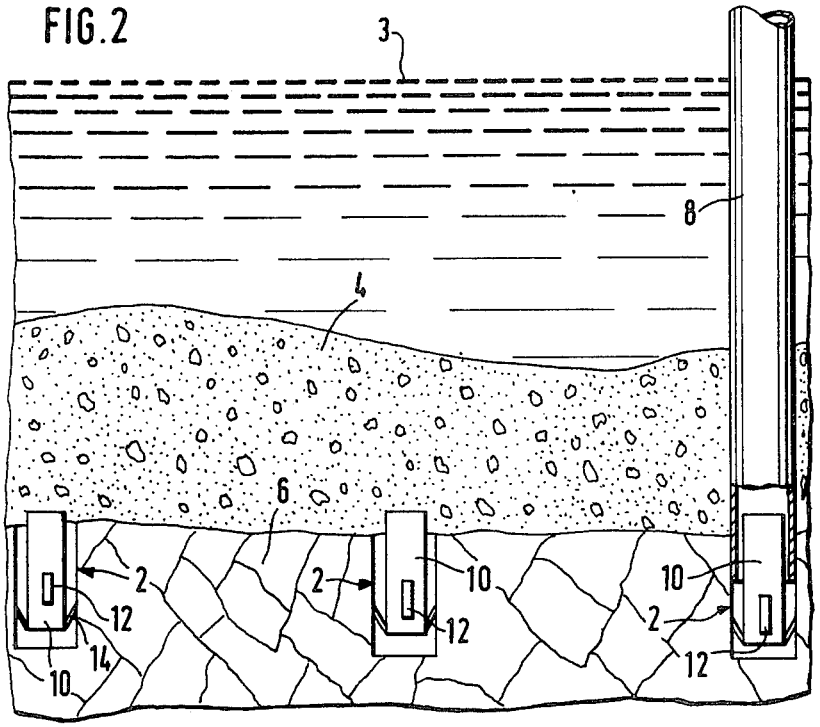

FIGS. 1 and 2 show diagrammatically the procedure when constructing a sheet pile wall. The sheet pile wall itself is not shown, its position being indicated by the dot-and-dash line 1 in FIG. 1. Along this broken line 1, a plurality of boreholes are sunk, the depth of the boreholes 2 and the water level 3 being visible in FIG. 2. Each borehole 2 extends through a possibly present overburden 4 into the upper layer of a rock substratum 6. For anchoring the sheet pile wall, its sheet piles should be driven into the rock substratum 6 for anchoring purposes to a depth which is approximately equal to the depth of the boreholes 2 within the substratum 6 (e.g., 30 cm).

Each borehole 2 is initially lined with a tube 8, so that no loose material can fall back from the overburden 4 into the new borehole. After drilling is completed, a container 10 is pushed through the tube 8 approximately to the bottom of the borehole. This container preferably consists of a piece of PVC tube, closed at each end with a cap. In one of these caps there is a watertight passage, not shown, for the detonating of an explosive charge 12, shown diagrammatically and housed inside the container. At the bottom end of each container 10, an antiflotation brake 14 is mounted, which bears against the container 10 when the latter is pushed into the borehole 2 and splays outwards if a movement occurs towards the mouth of the borehole, thus jamming the container inside the borehole.

After each container has been introduced, the tube 8 is pulled out of the borehole 2, the loose material of the overburden then again covering over the borehole together with the container. This of course applies only for the case in which the overburden 4 consists of a loose material which forms a conical slope. Where the overburden 4 consists of a firmer material, the borehole remains substantially unaltered, which is not of importance for the carrying out of the method according to this invention. As a departure from the view shown in FIG. 2, loose material from the overburden 4 may without disadvantage flow back also into the intermediate space between the borehole 2 and the outer face of the container 10. In each case, a sufficiently large expansion volume remains inside the container 10 for the preliminary expansion after the detonation of the explosive charge 12.

Depending upon the tolerance level of the surroundings and the length of the sheet pile wall to be constructed, the charges 12 are then detonated by sections or all simultaneously, causing shattering of the rock structure between the boreholes 2 to the desired extent. The effect of the blasts and the borehole depth have previously been determined empirically by trial bores and trail explosions, for which usually two to three tests are sufficient, so that the result of the blasting device achieves an extremely high success rate.

The pressure waves emitted from a borehole 2 give rise to the most intense shattering of the rock substratum 6 particularly within the cone shown in FIG. 1 diagrammatically in dot-and-dash lines 5, which is predominantly attributable to the fact that the pressure waves from two boreholes 2 meeting each other with a speed of approximately 6,000 m/sec are reflected from one another and from freshly formed fissures within the rock substratum 6, amplify and deflect each other, without however blasting away the rock. A portion of the overburden is here upwardly accelerated, but then sinks substantially vertically downwards, since it is retarded by the overlying water.

After the blasting of a section or of all the charges 12, hardly any change has occurred to the soil structure. As previously, the overburden overlies with a possibly highly varible thickness the rock substratum 6, which externally has hardly changed but is now drivable. Any residue of containers remaining within the rock substratum 6 has no adverse effect upon later pile driving, since they are cut up or forced to one side by the lower edge of a sheet pile. Moreover, it has been found that usual sheet piles can be driven with a number of blows from 25 to 40, with a maximum value of 50, for 10 cm penetration into the rock substratum 6 with its shattered structure.

The method according to this invention for driving the sheet piles has been described with reference to a soil situation, in which an overburden 4 with water above it is present above the rock substratum 6. The method according to this invention can, of course, also be used for making a rock substratum 6 drivable, which is exposed without any such overburden 4. Such very simply ground conditions are, however, seldom encountered, so that an overburden can be regarded as the normal case. The method according to this invention for the driving of sheet piles can be used with particular advantage and cost saving under these conditions.

Figure 3:
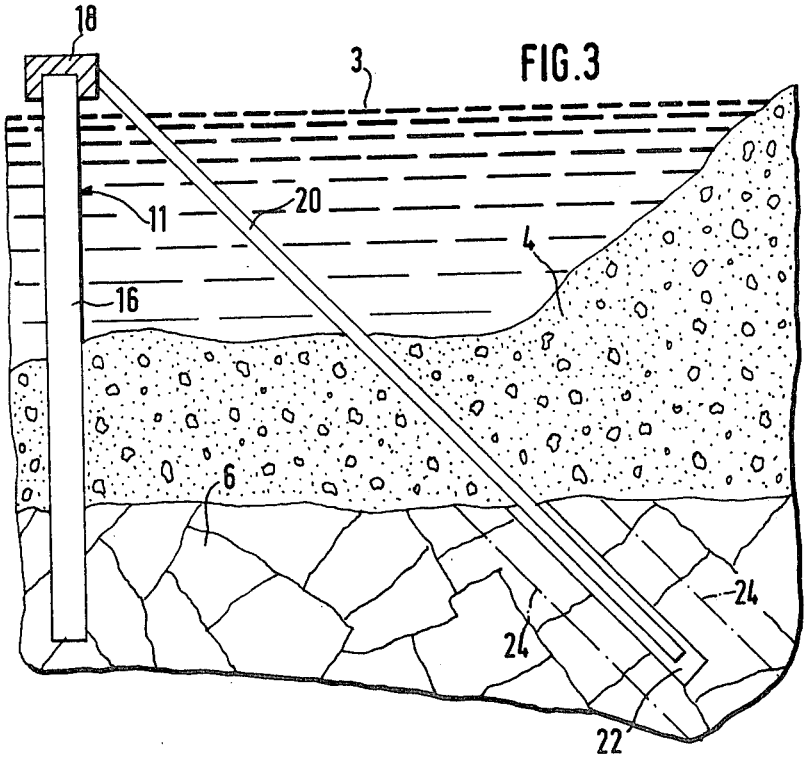

An explanation will now be given with reference to FIGS. 3 and 4 of how, according to this invention, the fixing of the anchors for a sheet pile wall in a rock stratum below water is carried out. FIG. 3 shows diagrammatically in cross-section the portion of a typical bank landscape, which has been stabilised and levelled with the help of the sheet pile wall 11. The individual piles 16 of the wall 11 are driven through the drivable overburden 4 into the rocky stratum 6, using the method described above. The upper end of the individual sheet piles 16 of the wall 11 are joined together by a waling 8 as an upper closure.

The region to the right of the sheet pile wall 11, which in the situation shown is still filled with water, is backfilled after the finishing, stabilising and levelling of the bank area, so that an earth pressure acting towards the left on the sheet pile wall 11 is present. This exerts on the wall 11 a bending moment and a shearing force, which cannot be resisted by the sheet pile wall 11 itself. An anchorage must therefore be provided, preferably at uniform intervals along the wall 11, this anchorage being usually installed in the form of anchors 20 on the shore side extending downwards at approximately 45° from the top of the sheet pile wall into the ground.

Whereas previously these anchors 20 had the form of an angle or a flat section, the invention now provides that a sheet pile wall of the same type as the piles 16 is also used as the anchor. For the installing of these anchor sheet piles 20, at least one borehole 22 with a diameter of 32–65 mm is sunk through the overburden 4 into the rock substratum 6 at the angle at which the anchors 20 will subsequently lie. Simultaneously with the progress of drilling, a tube (not shown) is introduced, so that the borehole 22, after the drill has been removed, will not fall in. One or more watertight containers, containing an explosive charge, are then introduced through this tube into the borehole 22 and secured against flotation. The tube can then be withdrawn, and complete or partial subsequent collapse of material into the borehole 22 is not of importance.

Figure 4A:
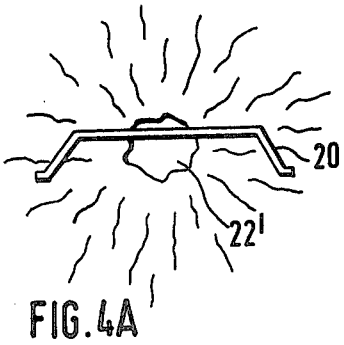
Figure 4B:
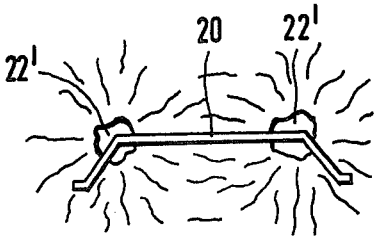

Depending upon the soil conditions present, a single borehole 22 may be sufficient for each anchorage sheet pile 20, but it may also be necessary to sink two boreholes 22 alongside each other and to supply them with appropriate charges inside watertight containers. In general, one charge-container per borehole is sufficient, but when in the case of particularly long boreholes with a single container and the charge situated therein, an adequately uniform alteration of the rock structure surrounding the boreholes cannot be achieved along the borehole axis in the desired manner, the provision of several containers one behind the other may be more favourable. Regardless of the number of boreholes and containers chosen, all the charges associated with the anchor sheet pile 20 to be subsequently driven are simultaneously detonated, the strength of the charges and the associated expansion chambers within the containers being so adapted that the surroundings of the boreholes are shattered in their structure, and also each borehole is modified to an irregular hole 22', slightly increased in diameter. This is shown in FIG. 4A for the case of one borehole and in FIG. 4B for the case of two boreholes alongside each other for the anchor sheet pile 20. When driving the anchor sheet pile 20 into the hole (or holes) 22', a compaction of the surrounding rock occurs, which is responsible after the sheet pile has been driven for an especially firm seating, in particular for an extraordinarily high retaining force.

The alteration in the surroundings to the borehole 22' is approximately 500 mm in diameter and is shown diagrammatically in FIG. 3 in the form of broken lines 24. The anchor sheet pile 20 remains, during the entire driving operation, within this region, so that the capability for driving depends solely upon the increase in length of the frictional surfaces between the pile 20 and the rock 6 as driving progresses. At the completion of the driving operation, the sheet pile 20 is therefore firmly clamped along its entire driven length in the rock stubstratum 6, the hole (or holes) 22' being once again densely filled in the manner initially described by the displacement of material produced by the sheet pile 20.

In the anchors previously commonly used, no clamping in this sense is present, but the anchor pushed into the borehole obtains contact with the rock with the help of the filler material (e.g., concrete) injected into the remaining intermediate spaces in the borehole, no prestressing between the two parts being present, but only a slight bearing pressure resulting from gravity. The high instability of the previously known anchors is therefore virtually excluded by the anchorage process according to the present invention. Later vibrations therefore have no effect upon the stability of the anchorage, whether these vibrations are caused by impacts against the sheet pile wall 11 or by vibrations of the environment, for example by blasting in the waterway.

What is claimed is:

1. A method of driving the lower ends of sheet piles into a rock substratum for the purpose of constructing a sheet pile wall, comprising the steps of boring bore holes in the rock substratum and any over burden present at predetermined intervals along the intended sheet pile wall, inserting a water-tight container containing an explosive charge into each bore hole, selecting a small volume of the explosive charge relative to the volume of the container, detonating, simultaneously the explosive charges of at least two adjacent bore holes to shatter the rock substratum in its internal structure but leave the substratum almost undamaged in its external form between the bore holes, and, subsequently driving sheet piles into the rock substratum.

2. A method according to claim 1, wherein the water-tight container is formed of plastics material and is provided with antiflotation means to secure the container against flotation in the bore hole.

3. A method according to claim 2, wherein each container is made by cutting a length from a continuous tube and fitting end caps on the ends of the cut length of tube.

4. A method according to claim 2, wherein the plastics material is polyvinylchloride (PVC).

5. A method of anchoring a sheet pile wall in a rock substratum comprising the steps of selecting sheet pile for use as anchors for the sheet pile wall, drilling bore holes in the rock substratum at intervals on one side of the sheet pile wall and arranging the inclination of the bore holes to be at a predetermined angle obliquely downwards relative to an upper edge of the sheet pile in the line of the intended inclination of the anchors, selecting a diameter for each bore hole which is a lesser dimension than the maximum width of the sheet pile to be anchored therein, inserting a water-tight container containing an explosive charge into each bore hole, selecting the volume of explosive charge relative to the volume of the container such that, after the explosive charge has been detonated, the sheet pile to be anchored therein is drivable into the rock substratum in consequence of shattering of the rock substratum surrounding said bore hole and such that the bore hole dimensions are not significantly increased, and driving the sheet piles into the rock substratum to provide anchors with the driven direction of each sheet pile such that its inclination is parallel to that of the respective bore holes.

6. A method according to claim 5, wherein two adjacent bore holes are formed for each sheet pile such that the sheet pile may be driven into the rock substratum with its external edges approximately in the region of each hole.

7. A method according to claim 5, wherein at least two containers, each containing an explosive charge, are disposed one after another in a single bore hole and are simultaneously detonated.

8. A method according to claim 2, wherein a said container is furnished with a plurality of explosive charges, each of which are simultaneously detonated.

9. A method according to claim 5, wherein the containers are formed of plastics material and are secured by antiflotation means against flotation in the respective bore hole.

10. A method according to claim 8, wherein each container is made by cutting a length from a continuous tube and fitting end caps on the ends of the length of tube.

* * * * *

UNITED STATES PATENT AND TRADEMARK OFFICE

CERTIFICATE OF CORRECTION

PATENT NO. : 4,222,684
DATED : September 16, 1980
INVENTOR(S) : Winfried Rosenstock It is certified that error appears in the above-identified patent and that said Letters Patent are hereby corrected as shown below:

COL. 4, line 68, delete "flxity" and insert ---fixity---;

COL. 6, line 59, after "blasting" delete "device";

COL. 7, line 26, delete "simply" and insert ---simple---; and

COL. 10, line 14, delete "holes" and insert ---hole---.

Signed and Sealed this

*Third* Day of *February 1981*

[SEAL]

*Attest:*

RENE D. TEGTMEYER

*Attesting Officer*

*Acting Commissioner of Patents and Trademarks*